US008646580B2

(12) United States Patent
Rossignol

(10) Patent No.: US 8,646,580 B2
(45) Date of Patent: Feb. 11, 2014

(54) ELEVATOR CAGE BRAKE DEVICE

(75) Inventor: Eric Rossignol, Magadino (CH)

(73) Assignee: Inventio AG, Hergiswil (CH)

( * ) Notice: Subject to any disclaimer, the term of this patent is extended or adjusted under 35 U.S.C. 154(b) by 270 days.

(21) Appl. No.: 13/088,807

(22) Filed: Apr. 18, 2011

(65) Prior Publication Data

US 2011/0253485 A1 Oct. 20, 2011

(30) Foreign Application Priority Data

Apr. 19, 2010 (EP) ..... 10160328

(51) Int. Cl.
*B66B 5/28* (2006.01)

(52) U.S. Cl.
USPC ..... 187/352

(58) Field of Classification Search
CPC ..... B66B 5/16
USPC ..... 187/270, 343, 352, 359, 361, 363
See application file for complete search history.

(56) References Cited

U.S. PATENT DOCUMENTS 249,076 A * 11/1881 Moulton ..... 187/343
3,415,343 A 12/1968 Svensson
4,519,264 A * 5/1985 Inui ..... 74/409
6,349,798 B1 * 2/2002 McKay ..... 188/1.11 E
7,476,172 B1 * 1/2009 Langenfeld et al. ..... 475/83

FOREIGN PATENT DOCUMENTS

FR 2667305 A1 * 4/1992
JP 04365772 A * 12/1992
JP 8169665 A 7/1996
JP 2004051246 A 2/2004
WO 2010010023 A1 1/2010

OTHER PUBLICATIONS

English Machine Translation of FR 2667305 A1.*

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator installation comprises an elevator cage movable along guide rails and a counterweight movable along guide rails, wherein provided for braking the elevator cage and the counterweight is at least one brake device in which at least one gearwheel is disposed in mechanically positive connection with the guide rail and the gearwheel can be braked by a brake, wherein a first gearwheel is provided, which when the brake is triggered is disposed in mechanically positive connection with the guide rail, and wherein a second gearwheel is provided, which when the brake is activated is disposed in mechanically positive connection with the guide rail.

17 Claims, 5 Drawing Sheets

2 - ELEVATOR CAGE
4 - COUNTERWEIGHT
6 - DRIVE UNIT
8 - UPPERMOST STORY DOOR
9 - SECOND-UPPERMOST STORY DOOR
10 - FURTHER STORY DOOR
11 - LOWERMOST STORY DOOR
16A - WEDGE BRAKE
16B - WEDGE BRAKE
24 - TENSIONING WEIGHT

ELEVATOR CAGE BRAKE DEVICE

CROSS-REFERENCE TO RELATED APPLICATION

This application claims priority to European Patent Application No. 10160328.0, filed Apr. 19, 2010, which is incorporated herein by reference.

FIELD

The present disclosure relates to a brake device for an elevator cage or for an elevator installation.

BACKGROUND

Elevator cages usually have a brake device which is designed as a safety brake device for cases of emergency. This safety brake device is triggered by a speed limiter and stops the elevator cage by means of wedge braking at the guide rails if a nominal speed is exceeded. In normal operation, on the other hand, use is made of a brake device which is coupled with a drive and, for example, ensures that the elevator cage is stopped precisely at the level of the respective story door.

The drive of the elevator cage is in turn usually carried out by means of a drive pulley around which the supporting and drive means are guided. The brake device for normal operation is coupled with the drive and when required brakes the drive pulley so that the elevator cage—for example at a story stop—is held by the braking device.

Precise stopping of the elevator cage at the level of the respective story is not always guaranteed with elevator installations having substantial conveying heights, since the supporting and drive means are subject to stretching, in which case this stretching has to be corrected for stopping of the elevator cage flush with a story.

An elevator installation with an elevator cage with two vertical lateral guide structures and with two counterweights movable along the guide structures and with an own drive has become known from PCT/EP2009/059077. The elevator cage is connected by support means with the counterweights. Flat drives serve as independent drives. The flat drives are attached to mutually opposite cage sides of the elevator cage, wherein each flat drive has a rim gear engaging in complementary toothings provided at the guide structures. A rotational movement of the rim gear is thus converted into a vertical movement of the elevator cage. The rim gear is connected with the brake disc on which a disc brake acts.

SUMMARY

At least some embodiments disclosed herein provide a reliable brake device for a elevator installation, wherein the brake device avoids the disadvantages of a brake arranged at a stationary drive-pulley drive and the disadvantages of a brake arranged at a gearwheel drive traveling therewith.

Some embodiments comprise an arrangement of a brake device for normal operation of the elevator installation not at the drive pulley, but directly at the elevator cage itself. This brake device can be attached to a support frame of the elevator cage and can brake at the guide rails along which the elevator cage runs.

In the case of elevator cages which are suspended at the top at the support frame at the supporting and drive means, the brake device can be fastened to the support frame. In the case of elevator cages which are underslung at the lower side thereof by the supporting and drive means the brake device can be fastened to the support frame.

A design variant of a brake device for an elevator installation comprises a gearwheel which so engages in a rack at the guide rail or recesses in the guide rail that compensation is provided for lateral play of the guide rail. The teeth of the rack or the recesses are, for that purpose, wider than the teeth of the gearwheel.

The gearwheel can be connected by a shaft with a brake disc, which is gripped by a brake pad pair in the event of a braking process. The shaft can be formed integrally and rigidly, and it can be of two-part construction and connected with a splined coupling so that an axial compensating displacement along the axis of rotation of the shaft can take place between the gearwheel and the brake disc.

Moreover, the shaft or the shaft members can on either side of the splined coupling be optionally so designed or made of a material that the transfer of the braking torque takes place with damping or resiliently. The same result can also be achieved by one or more flexible couplings. In this manner the response behavior of the brake or the travel comfort of the elevator cage can be improved.

A further embodiment of a brake device provides not just one gearwheel, but two gearwheels, which are connected concentrically with one another and which both run in the rack or the recesses in the guide rail. The first gearwheel has a slightly larger diameter and a correspondingly greater toothing than the second wheel and is made of a soft and resilient material and drives the brake disc in the unbraked state. When, however, the brake is applied, the teeth of this first gearwheel yield and the teeth of the second, harder gearwheel thereby come into contact with the rack or the recesses in the guide rail. The first gearwheel can be made of, for example, plastics material or rubber, whereas the second consists of, for example, metal. In this manner running of the elevator cage with low noise output in the unbraked state can, in some cases, be provided, but also a secure gripping of the toothing in the braked state can be provided.

The described yielding of the teeth of the first gearwheel can, moreover, also be achieved in that the first gearwheel and the second gearwheel are connected together not rigidly, but by means of a coupling with defined flexibility. The teeth of the first gearwheel can in this case be rigid.

The toothing of the two gearwheels together with the rack or the recesses in the guide rail can be formed to be straight, but also inclined or helicoidal. The mounting of the gearwheels on the shaft can be carried out by a serrated coupling so that an axial compensating displacement of the gearwheels on the shaft in the case of curvatures in the course of the guide rail track can take place.

The brake device can comprise a respective shaft or a respective shaft pair, which is coupled with a serrated coupling, with a respective gearwheel pair and a respective brake disc for each guide rail. However, a variant of embodiment is also conceivable in which the gearwheel pairs for two guide rails are connected together by means of a single shaft or a shaft arrangement coupled with splined couplings. This variant of embodiment can have a single, preferably centrally arranged, brake disc.

Moreover, a further variant of embodiment of the brake device provides that not only a toothing or rack, but also a row of recesses are provided at the guide rails. The plastics material gearwheel runs in the toothing or rack and the metal gearwheel runs in the row of recesses with a play and without contact with the recesses. The plastics material gearwheel and the metal gearwheel are connected together by a coupling with defined flexibility so that the metal gearwheel forms a mechanically positive connection with the recesses only under a braking load.

In some embodiments, it is possible to use a brake device not only as a static holding brake, but also as a dynamic brake. In the first case the braking device is actuated only when the elevator cage is stationary. The brake device can also be used for decelerating the elevator cage and is fully applied when the position of the elevator is reached.

A brake device designed as a dynamic brake can, moreover, be equipped with a braking energy recovery system in that provided at the end face of the brake disc is a further toothing in which a gearwheel of a generator engages. The generator develops, by its current generation, a braking action, which can be designed to be weaker than the maximum braking action of the brake pads against the brake disc. The thus-obtained energy is stored in a battery and is available for power supply of the drive, another constant power supply or an emergency power supply.

In at least some embodiments (but not necessarily all), the brake device or an elevator installation equipped with a brake device has the following advantages by comparison with a conventional brake device or by comparison with a elevator installation with a conventional brake device:

- Avoidance of inaccuracies, which are caused by stretching of the supporting and drive means, when stopping at the story.
- The need for any corrective travels in the case of inaccurate positioning of the elevator cage at the story doors is eliminated.
- Enhanced travel comfort of the elevator cage.
- Reduced wear of the brake pads in the case of a dynamic braking device with an upstream generator.

BRIEF DESCRIPTION OF THE DRAWINGS

The disclosed technologies are explained in more detail symbolically and by way of example on the basis of figures. The figures are described conjunctively and in general. The same reference numerals indicate the same components and reference numerals with different indices indicate functionally equivalent or similar components.

In that case.

DETAILED DESCRIPTION

Figure 1:
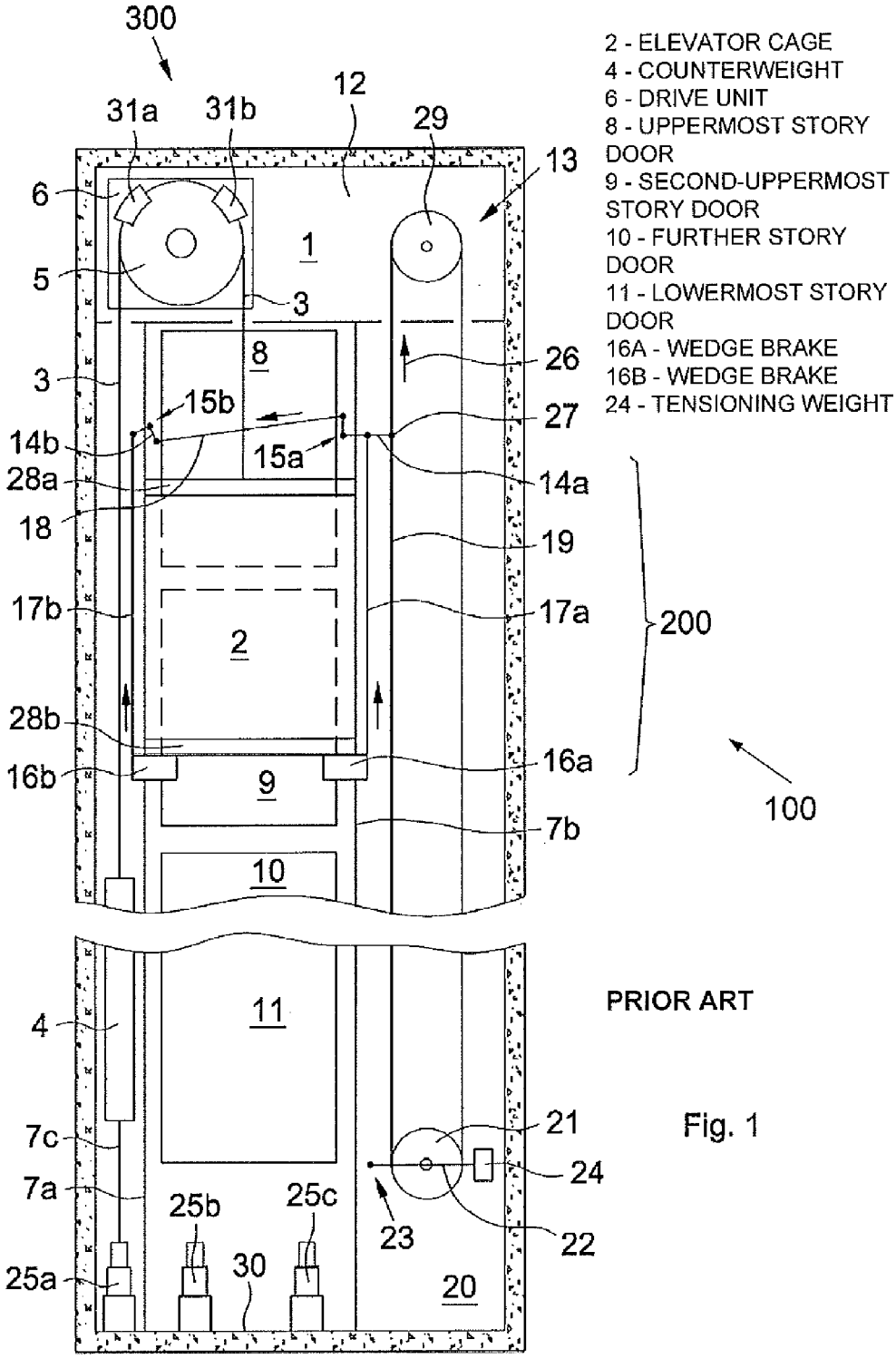
PRIOR ART Fig. 1
FIG. 1 shows a schematic illustration of an elevator installation according to the prior art, with a first brake device or safety brake device at a elevator cage and a second brake device at a drive pulley of the drive.

FIG. 1 shows an elevator installation 100 with an elevator cage 2, which is movable in an elevator shaft 1 and which is connected with a counterweight 4 by way of supporting and drive means 3. The supporting and drive means 3 is, in operation, driven by a drive pulley 5 of a drive unit 6. The elevator cage 2 comprises an upper yoke or support frame 28*a* and a lower yoke or support frame 28*b*. The elevator cage 2 and the counterweight 3 are guided by means of guide rails 7*a* and 7*b*, which extend over the shaft height, for the elevator cage 2 and a guide rail 7*c* for the counterweight 4. The elevator installation 100 has an upper story with an uppermost story door 8, a second-uppermost story with a second-uppermost story door 9, further stories with a further story door 10 and a lowermost story with a lowermost story door 11.

The drive unit 6 and a speed limiter 13, which stops the elevator cage 2 in the case of excessive speed, are arranged in a shaft head or an engine room 12. Arranged for this purpose at each of two opposite sides of the elevator cage 2 is a respective double lever 14*a* or 14*b* which is articulated to the elevator cage 2 at a respective fulcrum 15*a* or 15*b*. Moreover, the double lever 14*a* is fixedly connected with a limiter cable 19 of the speed limiter 13 by means of a cable coupling 27. The limiter cable 19 is guided in the shaft head 12 over a cable pulley 29 of the speed limiter 13 and in a shaft pit 20 over a deflecting roller 21. During travel the elevator cage 2 drives the limiter cable 19 and the speed of the elevator cage 2 is monitored via the limiter cable 19 by the speed limiter 13. In the event of excess speed of the elevator cage 2 the speed limiter 13 blocks the cable pulley 29, in which case the elevator cage 2 in the illustrated exemplifying embodiment drags the limiter cable 19 over the cable pulley 29.

Due to the friction at the cable pulley 29, the limiter cable 19 exerts on the double lever 14*a* a tension force 26, which is indicated by a directional arrow, in upward direction. Thus-actuated, the double lever 14*a* rotates about the fulcrum 15*a*. As a result, on the one hand a tension is transmitted in upward direction by way of a linkage 17*a* to a first wedge brake 16*a* and to a second wedge brake 16*b*. The double lever 14*a* transmits a pressure movement to a connecting rod 18 by means of a rigid, approximately 90-degree bracket which is articulated at its apex to the elevator cage 2 at the fulcrum 15*a*. This connecting rod 18 in turn presses on the second double lever 14*b*, which, similarly to the first double lever 14*a*, is formed from a rigid, approximately 90-degree bracket, which is articulated at its apex to the elevator cage 2 at the fulcrum 15*b*. The pressure of the connecting rod 18 thus produces a rotation of the double lever 14*b* and this in turn is transmitted by a linkage 17*b* as a traction movement to the second cable brake 16*b*.

The double levers 14*a* and 14*b*, the connecting rod 18, the linkages 17*a* and 17*b* and the wedge brakes 16*a* and 16*b* form an exemplifying emergency safety brake device or first brake device 200 of the elevator installation 100. In principle, it is also possible to couple the traction movement 26 of the limiter cable 19 with a lever arrangement which triggers the wedge brakes 16*a* and 16*b* not by pulling, but by pushing, or it is possible to arrange the connecting rod 18 in such a manner that it is loaded in tension in the case of actuation.

The limiter cable 19 is tightened by means of the deflecting roller 21 arranged in the shaft pit 20, wherein a roller axle mounting 22 is articulated at one end at a fulcrum 23 and carries a tensioning weight 24 at the other end. The supporting and drive means 3 as well as the limiter cable 19 can be a steel wire cable or aramide cable, a belt or band or a V-belt or wedge-ribbed belt.

A buffer 25 for the counterweight 4 is arranged on a shaft floor 30 of the shaft pit 20 as well as two buffers 25*b* and 25*c* for the elevator cage 2.

The elevator installation 100 can comprise a second brake device 300 for normal operation, which consists substantially of two drive pulley brakes 31*a* and 31*b* which, when required, brake the drive pulley 5 or hold it at standstill.

Figure 2:
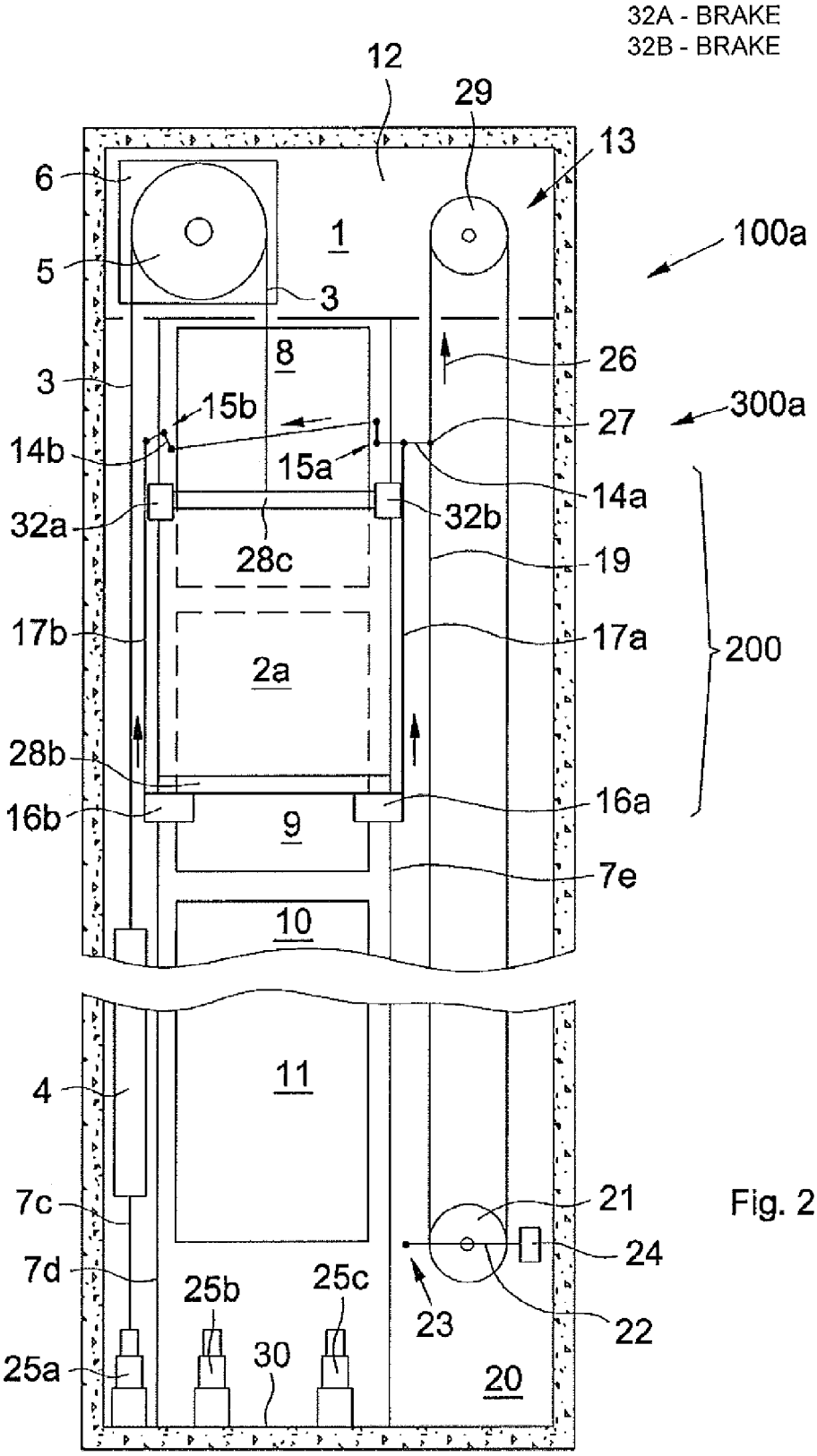
FIG. 2 shows a schematic illustration of an elevator installation with a second brake device, similarly at the elevator cage.

FIG. 2 schematically shows an elevator installation 100*a* which is characterized in that a second brake device 300*a* for the normal operation is no longer arranged at the drive pulley 5 or the drive unit 6, but at an elevator cage 2*a* or at the counterweight 4. This second brake device 300*a* comprises two brakes 32*a* and 32*b*, which respectively brake at guide rails 7*d* and 7*e*, and is illustrated arranged schematically and, for the sake of better clarity of the figure, at an upper yoke or upper support frame 28*c*. The brake device 300*a* can also be arranged together with the wedge brakes 16*a* and 16*b* of the safety brake device 200 at the lower yoke or lower support frame 28*b*. The second brake device 300 can also take over the task of the first brake device 100. In this case the second brake device operates as a working brake and in the case of emergency as a safety brake. The elevator cage or the counterweight is then provided merely with the second brake device 300.

Figure 3:
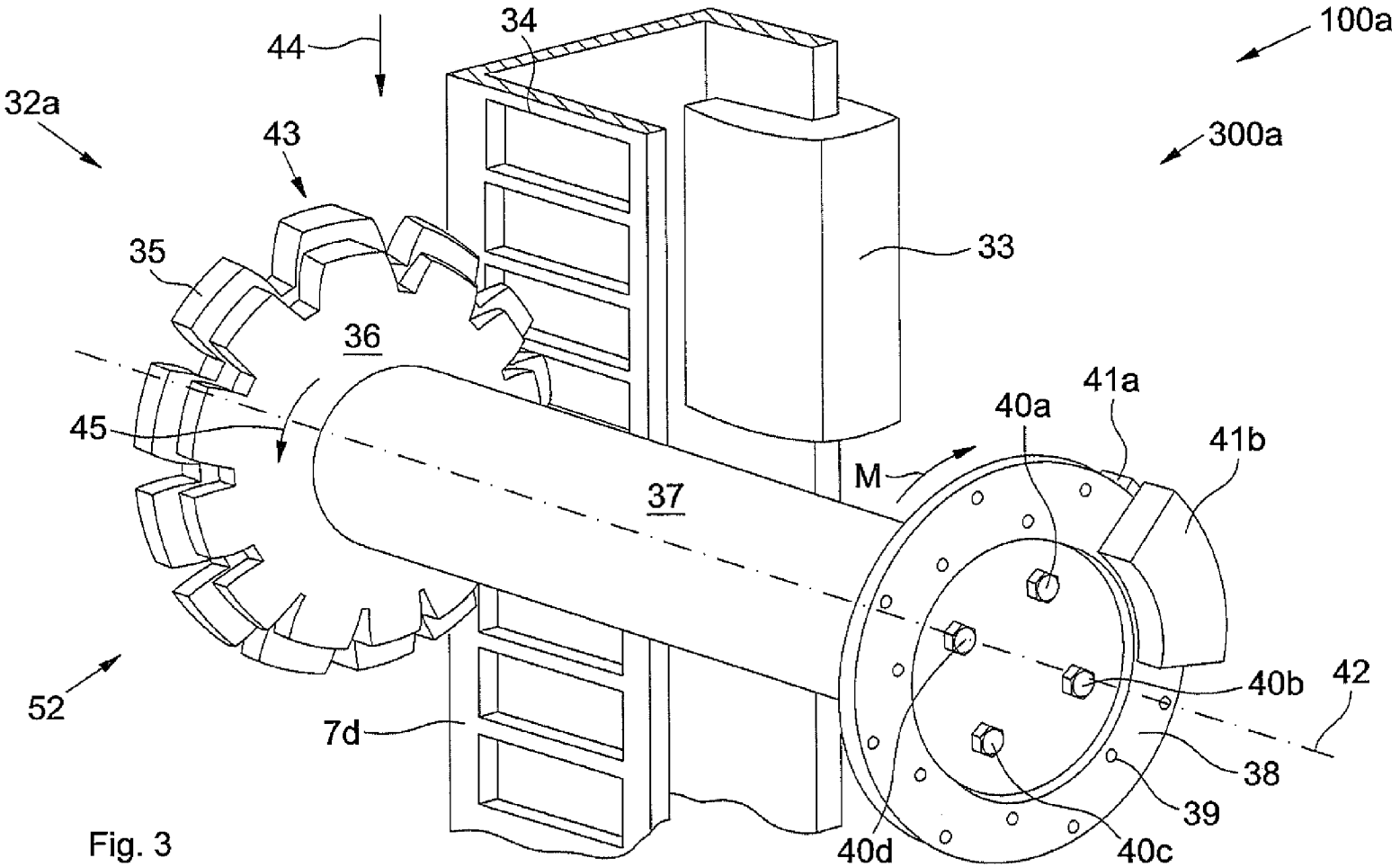
FIG. 3 shows a schematic and perspective part illustration of a first embodiment of a second brake device.

In FIG. 3 it is shown in a schematic part illustration how the brakes 32*a* and 32*b* of the elevator installation 100 of FIG. 2 can be designed and together form the second brake device 300*a*. The guide rail 7*d* has the cross-section of a U-profile and thus a first flank for guidance of a guide shoe 33, which is fixedly connected with the elevator cage 2*a* (not illustrated in more detail) or with the yoke or support frame 28*c*. A second flank of the U-profile of the guide rail 7*d* has a row of recesses 34 in which teeth of a first gearwheel 35 and a smaller, concentrically mounted second gearwheel 36 engage. These two gearwheels 35 and 36 form a gearwheel pair 52. The flank of the guide rail 7*d* with the row of recesses 34 can also be constructed as a rack 34.

The second gearwheel 36 can be turned integrally with a shaft 37, possibly of metal. The gearwheel 35, on the other hand, can be made of plastics material or rubber and is larger than the second gearwheel 36 and fastened thereto. The recesses 34 are preferably wider than tooth pairs 43 which are respectively formed by the teeth of the first gearwheel 35 and the teeth of the second gearwheel 36.

An axial displacement of the brake 32 along an axis 42 of rotation is thereby possible.

The shaft 37 can comprise a splined coupling (not illustrated in more detail) so that in addition to the axial displacement by virtue of the wider recesses 34 a further axial compensating displacement along the axis 42 of rotation can take place in this serrated coupling. The shaft 37 can be borne in bearings (not illustrated in more detail), possibly with roller bearings, and these bearings can be fixedly arranged at the elevator cage 2 or the support frame 28*c*. The shaft 37 is in addition screw-connected by means of screw connections 40*a*-40*d* with a brake disc 38, which can have optional bores 39 to promote improved temperature behavior.

If the brake disc 38 is braked or held by brake pads 41*a* and 41*b* arranged in pairs, a braking torque M, which acts against a rotational movement 45 of the shaft 37, arises in the case of a downward movement 44, which is illustrated by way of example, of the elevator cage 2*a*. In the case of appropriate strength of the torque M, the teeth of the first gearwheel 35 or the first gearwheel 35 itself yields or yield and the teeth of the second gearwheel 36 come into engagement with the recesses 34. If, however, the brake pads 41*a* and 41*b* are open or the torque M is low, exclusively the teeth of the first gearwheel 35 remain in engagement with the recesses 34. In the case of an unbraked brake disc 38, the teeth of the first gearwheel 35 form at the recesses 34 a mechanically positive couple with the guide rail 7*d*. In the case of a braked brake disc 38, the teeth of the second gearwheel 36 form at the recesses 34 a mechanically positive couple with the guide rail 7*d*.

Figure 4:
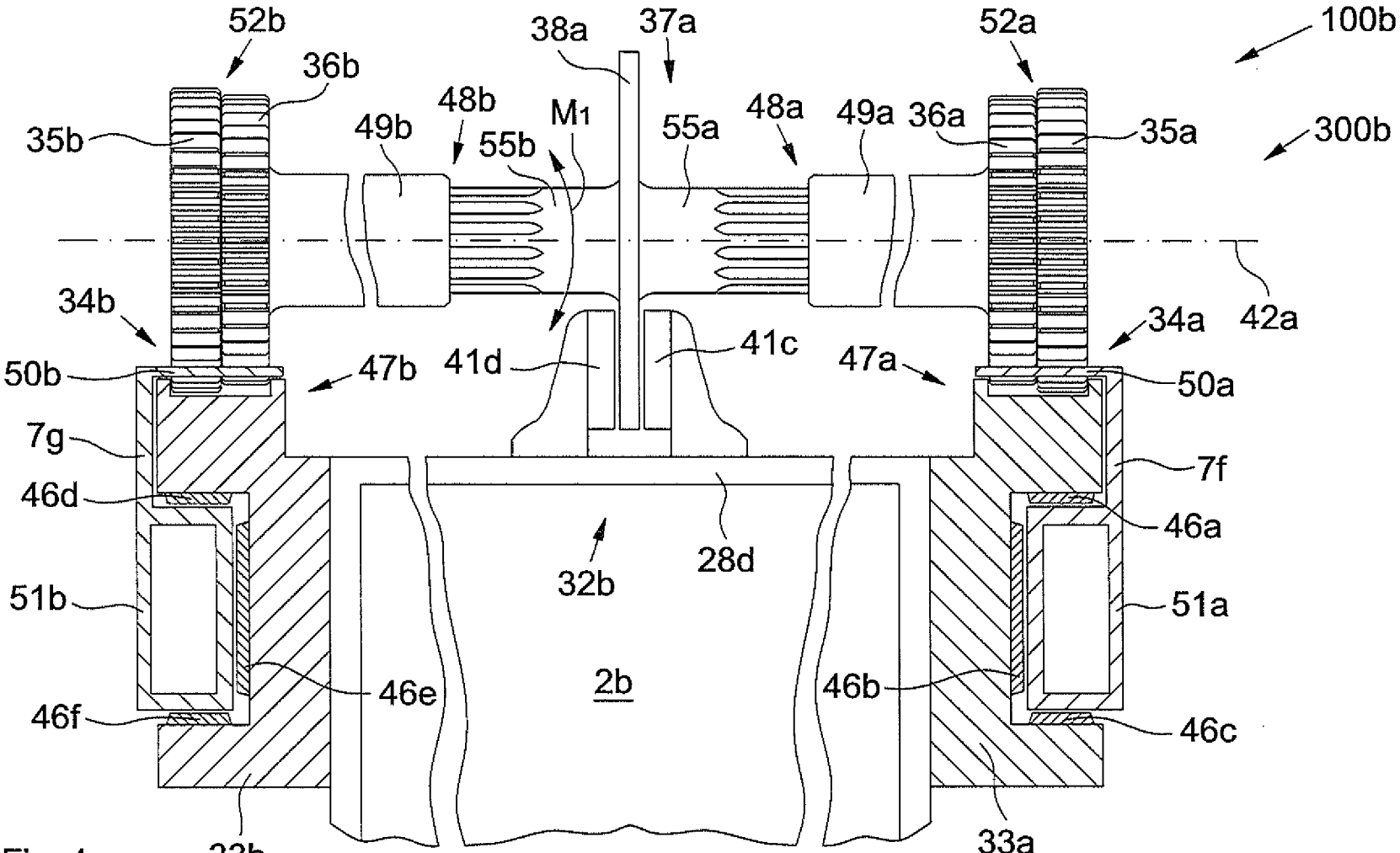
FIG. 4 shows a schematic and sectional part illustration of a second embodiment of a second brake device.

A second embodiment of a second brake device 300*b* in an elevator installation 100*b* is schematically illustrated in FIG. 4. A first guide rail 7*f* and a second guide rail 7*g* are arranged in pairs and respectively form a four-sided profile 51*a* or 51*b* and an angle profile 50*a* or 50*b*. The four-sided profiles 51*a* and 51*b* are each enclosed in U-shape by a respective guide shoe 33*a* and 33*b* and lined with slide faces 46*a*-46*c* or 46*d*-46*f*. The guide shoes 33*a* and 33*b* are fastened to a support frame 28*d* of an elevator cage 2*b*.

The angle profiles 50*a* and 50*b* have recesses 34*a* and 34*b* in which teeth of a first gearwheel 35*a* or 35*b* and a second, smaller concentrically arranged gearwheel 36*a* or 36*b* respectively engage. The gearwheels 35*a* and 36*a* form a gearwheel pair 52*a* and the gearwheels 35*b* and 36*b* form a gearwheel pair 52*b*, which are respectively secured by a securing shoe 47*a* or 47*b* against axial displacements along an axis 42*a* of rotation.

In contrast to the second brake device 300*a* of FIG. 3, the second brake device 300*b* additionally has a common shaft 37*a* which can be turned integrally with a brake disc 38*a*. The brake disc 38*a* and brake pads 41*c* and 41*d* form a single brake 32*b*, instead of two as in the brake device 300*a* of FIG. 3.

The shaft 37*a* and the gearwheel pairs 52*a* and 52*b* are connected together by force-locking couple in that opposite shaft members 55*a* and 55*b* of the shaft 37*a* are each introduced by means of a respective splined coupling 48*a* or 48*b* into a shaft flange 49*a* or 49*b*. In this manner, transmission of a braking torque $M_1$ (directionally dependent according to the respective upward or downward movement of the elevator cage 2*b*) to the gearwheel pairs 52*a* and 52*b* or to the angle profiles 50*a* and 50*b* of the guide rails 7*f* and 7*g* is guaranteed, with simultaneous possible axial compensating displacement of the shaft 37*a* along the axis 42*a* of rotation. Even if the guide rails 7*f* and/or 7*g* should bulge out, the brake disc 38*a* runs relatively freely between the brake pads 41*c* and 41*d*.

Figure 5:
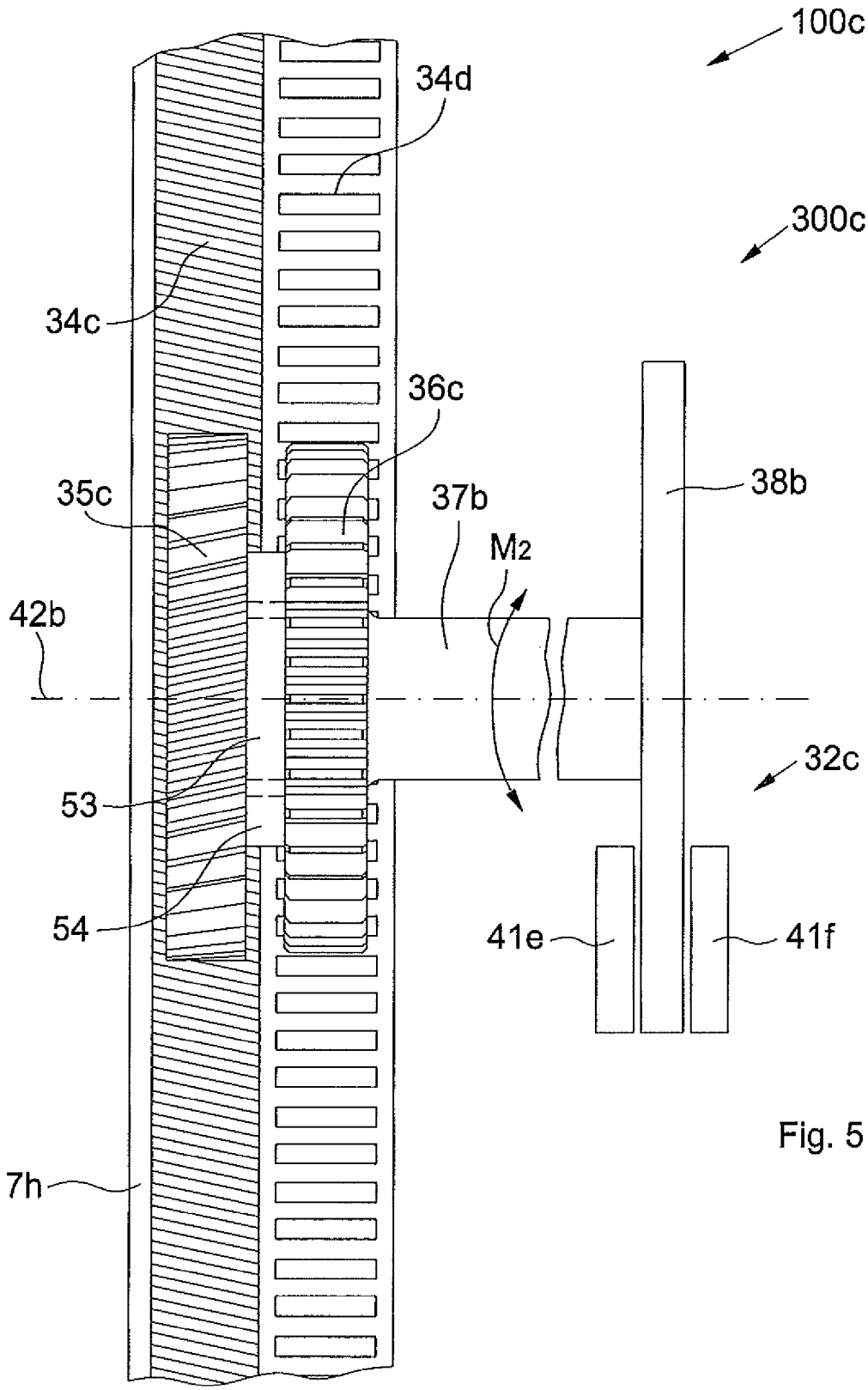
FIG. 5 shows a schematic part illustration of a third embodiment of a second brake device.

FIG. 5 schematically shows a third embodiment of a second brake device 300*c*. A guide rail 7*h* provides an obliquely toothed rack or toothing 34*c* for a first gearwheel 35*c*. This first gearwheel 35*c* is, as before, made of a soft deformable material and can allow, by a connection 53 with a shaft 37*b*, for co-rotation of a brake disc 38*b*, which is arranged between brake pads 41*a* and 41*f* and thus forms a brake 32*c*.

If the brake 32*c* builds up—respectively depending on upward or downward movement of the elevator cage and corresponding rotational movement about an axis 42*b* of rotation—a braking torque $M_2$ in the opposite direction of the first gearwheel 35*c*, which in itself twists, the first gearwheel 35*c* transmits this braking torque $M_2$ by means of a flexible coupling 54, which annularly surrounds the connection 53, to a second gearwheel 36*c*, the teeth of which engage—in some cases only under this load—in a separate row of recesses 34*d* provided only for this purpose. Otherwise, without load, the teeth of the second gearwheel 36*c* run freely and without contact with the recesses 34*d*. As also in the case of the previous, second braking devices 300*a* and 300*b*, this second gearwheel 36*c* is made of a rigid, torsionally stiff material which, however, accepts a correspondingly large braking torque $M_2$ with damping thanks to the flexible coupling 54.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator brake device, comprising:

a brake;

a first gearwheel coupled to the brake; and a second gearwheel coupled to the brake, the first and second gearwheels being concentrically arranged with each other, the first gearwheel being configured to engage at least a first portion of an elevator installation guide rail, and the second gearwheel being configured to engage at least a second portion of the elevator installation guide rail only when the brake is activated, wherein the second gearwheel has a smaller diameter than the first gearwheel.

2. The elevator brake device of claim 1, wherein the first gearwheel comprises a resiliently deformable material and is coupled with the second gearwheel, and wherein the second gearwheel comprises a metal material.

3. The elevator brake device of claim 1, wherein the first gearwheel comprises a first set of teeth and the second gearwheel comprises a second set of teeth, each of the first and second sets of teeth being configured to engage at least a portion of recesses on the elevator installation guide rail.

4. The elevator brake device of claim 3, wherein the recesses have a width larger than a width of the first gearwheel or larger than a width of the second gearwheel.

5. The elevator brake device of claim 3, wherein the first set of teeth comprises inclined teeth.

6. The elevator brake device of claim 3, wherein the first set of teeth is configured to engage a first row of recesses on the elevator installation guide rail and the second set of teeth is configured to engage a second row of recesses on the elevator installation guide rail.

7. The elevator brake device of claim 1, the brake comprising a brake disc, the brake device further comprising a shaft coupled to the first and second gearwheels and the brake disc.

8. The elevator brake device of claim 7, wherein the shaft comprises at least one shaft member, the at least one shaft member being connected to a shaft flange by a splined coupling.

9. The elevator brake device of claim 7, wherein the shaft comprises a resilient material.

10. The elevator brake device of claim 9, wherein the shaft is configured to transmit a braking torque to the elevator installation guide rail under damping.

11. The elevator brake device of claim 7, wherein the shaft comprises at least one flexible coupling.

12. The elevator brake device of claim 1, wherein the first gearwheel is coupled to the second gearwheel by a flexible coupling.

13. The elevator brake device of claim 1, further comprising a third gearwheel coupled to the brake and a fourth gearwheel coupled to the brake, the third gearwheel being configured to engage at least a third portion of another elevator installation guide rail, and the fourth gearwheel being configured to engage at least a fourth portion of the another elevator installation guide rail only when the brake is activated.

14. The elevator brake device of claim 1, wherein the device is configured to be coupled to a generator.

15. An elevator installation, comprising:

an elevator cage;

a counterweight;

one or more guide rails, the elevator cage and the counterweight being configured to move along the one or more guide rails; and a brake device coupled to the elevator cage or the counterweight, the brake device comprising a brake, a first gearwheel coupled to the brake and a second gearwheel coupled to the brake, the first and second gearwheels being concentrically arranged with each other, the first gearwheel being configured to engage at least a first portion of one of the guide rails, and the second gearwheel being configured to engage at least a second portion of the one guide rail only when the brake is activated, wherein the second gearwheel has a smaller diameter than the first gearwheel.

16. The elevator installation of claim 15, wherein the first gearwheel comprises a deformable material and the second gearwheel comprises a metal material.

17. The elevator installation of claim 15, further comprising an elevator drive means coupled to the elevator cage and the counterweight.

* * * * *